US006602085B2

(12) United States Patent
Young et al.

(10) Patent No.: US 6,602,085 B2
(45) Date of Patent: Aug. 5, 2003

(54) G-LOAD COUPLING NUT

(75) Inventors: Thomas Frederic Young, Simi Valley, CA (US); Nestor Fuertes, Arleta, CA (US); David W. Tonkiss, Glendale, CA (US)

(73) Assignee: Glenair, Inc., Glendale, CA (US)

( * ) Notice: Subject to any disclaimer, the term of this patent is extended or adjusted under 35 U.S.C. 154(b) by 0 days.

(21) Appl. No.: 09/861,224

(22) Filed: May 18, 2001

(65) Prior Publication Data

US 2002/0058437 A1 May 16, 2002

Related U.S. Application Data

(63) Continuation-in-part of application No. 09/712,597, filed on Nov. 14, 2000, now Pat. No. 6,358,077.

(51) Int. Cl.[7] ..... H01R 4/38

(52) U.S. Cl. ..... 439/321

(58) Field of Search ..... 439/310, 312, 439/313, 319, 320, 321, 322, 323, 905

(56) References Cited

U.S. PATENT DOCUMENTS

| | | | | | |
|---|---|---|---|---|---|
| 4,902,238 | A | * | 2/1990 | Iacobucci | 439/135 |
| 5,035,640 | A | * | 7/1991 | Drogo | 439/321 |
| 5,192,219 | A | * | 3/1993 | Fowler et al. | 439/321 |
| 5,429,524 | A | * | 7/1995 | Wakata et al. | 439/310 |
| 5,580,278 | A | * | 12/1996 | Fowler et al. | 439/609 |
| 5,590,228 | A | * | 12/1996 | Gibola et al. | 385/56 |
| 5,653,605 | A | * | 8/1997 | Woehl et al. | 439/321 |
| 6,086,400 | A | * | 7/2000 | Fowler | 439/321 |
| 6,358,077 | B1 | * | 3/2002 | Young | 439/321 |

* cited by examiner

*Primary Examiner*—Khiem Nguyen
*Assistant Examiner*—Thanh-Tam Le
(74) *Attorney, Agent, or Firm*—Katten Muchin Zavis Rosenman

(57) ABSTRACT

A backshell adapter assembly includes an adapter body, a coupling nut and a one-piece shuttle mechanism. The one-piece shuttle mechanism is formed as a tubular member and is adapted to be received in a retaining groove on the adapter body. The one piece shuttle mechanism includes a thrust bushing and one or more concentrically formed spring arms that are adapted to provide axial loading in the direction of an electrical connector shell when the basketball adapter assembly is assembled to an electrical connector.

19 Claims, 9 Drawing Sheets

G-LOAD COUPLING NUT

CROSS-REFERENCE TO RELATED APPLICATIONS

This is a continuation-in-part, of prior application Ser. No. 09/712,597, filed Nov. 14, 2000, now U.S. Pat. No. 6,358,077 which is hereby incorporated herein by reference in its entirety.

BACKGROUND OF THE INVENTION

1. Field of the Invention

The present invention relates to an accessory for an electrical connector and more particularly to a backshell adapter assembly which includes an adapter body formed with anti-rotation teeth, a threaded coupling nut, a retaining ring and a one-piece shuttle with one or more integrally formed spring arms that are adapted to provide an axial biasing force to force proper mating of the anti-rotation teeth on the adapter body relative to corresponding teeth on an electrical connector when the coupling nut is being secured thereto.

2. Description of the Prior Art

Backshell adapter assemblies are known in the art. Such backshell adapter assemblies normally provide a transition from a plurality of electrical conductors to an electrical connector. An example of such backshell adapter assemblies is disclosed in commonly-owned U.S. Pat. No. 5,580,278.

Known backshell adapter assemblies normally include an adapter body, normally tubular in shape, and a coupling nut. In order to secure the coupling nut relative to the adapter body, a retaining ring is normally used. The coupling nut is normally threaded onto an electrical connector. In order to prevent rotation of the backshell adapter assembly relative to the electrical connector, anti-rotation teeth are provided on the adapter body as well as on the electrical connector which interlock and prevent rotation of the coupling nut relative to the electrical connector, for example, as disclosed in commonly-owned U.S. Pat. No. 5,580,278.

If the interlocking teeth on the adapter body and the connector shell properly mate, rotation of the backshell adapter assembly relative to the electrical connector will be prevented. Unfortunately, false mating of the interlocking teeth on the adapter body and the connector shell is known to occur. The false mating can occur when the rotational force of the coupling nut resulting from threading the coupling nut onto the electrical shell causes radial forces on the backshell adapter assembly which causes the backshell adapter assembly to rotate resulting in the interlocking teeth engaging point to point. During such a condition, since the interlocking teeth are hidden from view, an installer may be unaware of the false mating. As such, such a configuration enables the installers to tighten the coupling nut to the desired torque level without being aware of the false mating thus defeating the anti-rotation feature of the backshell adapter assembly possibly resulting in rotation and loosening and even disengagement of the adapter body relative to the connector shell, for example, due to vibration.

Various solutions have been presented in the art to prevent false mating of the interlocking teeth on the backshell adapter assembly with the interlocking teeth on the connector shell. These various solutions generally involve providing an axial force sufficient to overcome any rotational forces that occur during tightening of the coupling nut to force the interlocking teeth into engagement.

One such solution is illustrated in FIGS. 1 and 2. Referring to FIGS. 1 and 2, a known backshell adapter assembly is illustrated and generally identified with the reference numeral 20. The backshell adapter assembly 20 includes an adapter body 21, formed with anti-rotation teeth, aligned in an axial direction and generally identified with the reference numeral 24, a thrust bushing 26, a Bellville washer 28, a coupling nut 30 and a pair of C-clips 27, which are adapted to be received in a retaining groove 29 on the thrust bushing 26, forming a retaining ring. The backshell adapter assembly 20 also includes an anti-decoupling mechanism to prevent the coupling nut 30 from rotating relative to the adapter body 21. The anti-decoupling mechanism includes a plurality of teeth 32 disposed in a radial direction which cooperate with one or more leaf springs 34, 36, disposed in an annular grove 38 in the coupling nut 30. The leaf springs 34, 36 include one or more tabs 40 that are adapted to engage the teeth 32 to prevent rotation of the coupling nut 30 relative to the adapter body 22.

As shown in FIG. 1, the thrust bushing 26 is disposed in an annular groove 42 on the adapter body 21. As discussed above, the C-clips 27 are received in the retention groove 29 on the thrust bushing 26 and form a retaining ring. The retaining ring is adapted to be received in an annular groove 44 on the coupling nut 30 in order to capture the coupling nut 30 relative to the adapter body 22 to prevent movement in an axial direction.

As shown in FIG. 1, the Bellville washer 28 is disposed adjacent the retaining ring 26 in the annular groove 42 on the adapter body 22. In order to prevent false mating of the interlocking teeth 24 on the adapter body 22 with corresponding teeth on the connector shell (not shown), the Bellville washer 28 is used. More particularly, as the coupling nut 30 is threaded onto the connector shell (not shown) by way of the threads 46, the bellville washer 28 exerts an axial force in the direction of the arrow 44 which overcomes any anticipated radial forces which would tend to rotate the adapter body 22 which force the mating teeth 24 on the adapter body 22 into proper mating arrangement with the corresponding mating teeth on the connector shell.

U.S. Pat. No. 5,435,760 provides a similar solution. In particular, a Bellville or wave washer is used to provide an axial force in the direction of the electrical connector to overcome any rotational forces on the adapter body to ensure proper seating on the adapter body and connector shell.

There are several problems with the solutions discussed above. In particular, both solutions utilize a wave or Bellville washer, normally formed from tempered metal. As such, such washers are subject to corrosion and tend to vibrate severely and can damage to softer backshell materials, such as aluminum and high temperature thermoplastic composites. Another problem with the configuration illustrated in '760 patent is that the wave spring is tightened to a flattened condition to act as a retainer ring to capture the coupling nut which can permanently distort the wave washer causing it to lose its inherent memory.

The backshell adapter assembly 20 illustrated in FIGS. 1 and 2, solves the above-mentioned problem while also providing axial loading without the need to flatten the wave washer and use it as a retaining ring to axially couple the coupling nut to the adapter body. Indeed, as discussed above, the backshell adapter 20 illustrated in FIGS. 1 and 2 utilizes a thrust bushing with an annular groove for receiving one or more C-clips which act as a retaining ring thus obviating the need to use the Bellville washer as a retaining ring.

Although the configuration illustrated in FIGS. 1 and 2 provides an adequate solution to the problems discussed above, the adapter assembly 20 illustrated in FIGS. 1 and 2 include a relatively large number of parts making it relatively expensive to manufacture. Indeed, as discussed above, the prior art backshell adapter assembly 20 includes a two-piece shuttle mechanism which includes a thrust bushing and a Bellville washer. Moreover, the Bellville washer is made of metal and is subject to corrosion and vibration as discussed above. Thus, there is a need for a backshell adapter assembly which prevents false mating of interlocking teeth on the adapter body relative to the connector shelf which is formed with less parts and is less expensive to manufacture.

SUMMARY OF THE INVENTION

Briefly, the present invention relates to a backshell adapter assembly which includes an adapter body, a coupling nut, a retaining ring and a one-piece shuttle mechanism. The one-piece shuttle mechanism is formed as a tubular member and is adapted to be received in a retaining groove on the adapter body. In order to facilitate loading of the one-piece shuttle into the retainer groove on the adapter body, the one-piece shuttle is cut along its length to enable the cut ends of the device to be spread apart in order to load the shuttle mechanism into the retaining groove on the adapter body. In an alternate embodiment of the invention, the shuttle is formed with one or more radially extending protrusions formed in the shape of wedges. These protrusions provide a surface to compress the shuttle to enable the shuttle to be loaded into a coupling nut. In the alternate embodiment, a retaining groove is provided in the coupling nut which captures the protrusions when the shuttle returns to its original diameter. Once the protrusions are captured, axial movement of the shuttle with respect to the coupling nut is prevented, thus eliminating the need for a retaining ring. In yet another alternate embodiment of the invention, the adapter body is formed with a pair of annular grooves with a transition surface therebetween forming a recessed groove and a raised platform. In this embodiment, the extending protrusions on the one piece shuttle are forced into the recessed groove as the coupling nut is initially installed. As the coupling nut is further tightened, the protrusions are forced onto the raised platform and are captured by an annular shoulder formed as a mating protrusion on the interior mouth of the coupling nut. In all embodiments, the one piece shuttle mechanism includes a thrust bushing and one or more concentrically formed spring arms that are adapted to provide axial loading in the direction of an electrical connector shell when the backshell adapter assembly is assembled to an electrical connector. In accordance with another feature of the invention, the one-piece shuttle design is amenable to being formed from high temperature composite materials which eliminates the corrosion problem and minimizes damage during various extreme conditions such as extreme vibration conditions to portions of the backshell adapter assembly which are normally formed from aluminum. Another important aspect of the invention is that the one-piece shuttle assembly minimizes the number of parts required and thus significantly reduces the manufacturing costs of such backshell adapter assemblies.

DESCRIPTION OF THE DRAWINGS

These and other advantages of the present invention will be readily understood to the following specification and attached drawing wherein.

DETAILED DESCRIPTION

The present invention relates to a backshell adapter assembly for interfacing a plurality of electrical conductors (not shown) to an electrical connector. As will be explained in more detail below, the backshell adapter assembly in accordance with the present invention is configured with an anti-decoupling feature to prevent the backshell adapter assembly from being decoupled from an electrical connector. Such anti-decoupling mechanisms normally include interlocking teeth formed on the adapter body and the electrical connector shell. In accordance with an important aspect of the invention, a one piece shuttle device is provided, which, as will be discussed in more detail below, provides an axial force in the direction of the electrical connector which overcomes the initial rotational force on the backshell adapter when the backshell adapter is being coupled to an electrical connector without the problems associated with the prior art discussed above. The one piece shuttle may be formed from various high temperature composite material, which eliminates corrosion. The one piece shuttle also minimizes the number of parts, thus making the backshell adapter assembly less expensive to manufacture.

One embodiment of the invention is illustrated in FIGS. 3–7. FIGS. 8–13 illustrate another embodiment of the invention which eliminates the need for a retaining ring, thus further minimizing the number of parts. FIGS. 14A–15B illustrate yet another alternate embodiment of the invention which eliminates the need for a retaining ring in which the adapter body is formed with a pair of concentric grooves with a transition surface therebetween.

Figures 1, 2:
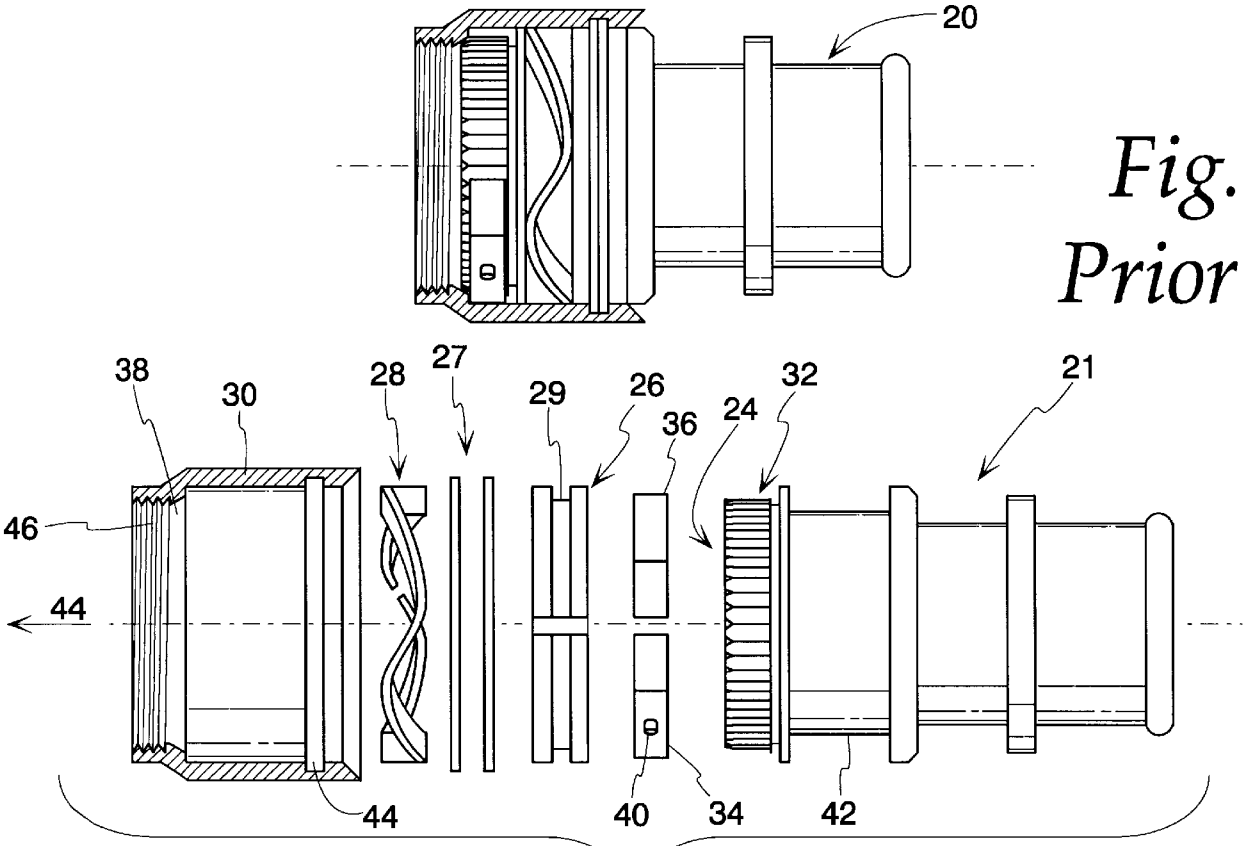
Fig. 1 Prior Art
Fig. 2 Prior Art
FIG. 1 is a sectional view of a known backshell adapter assembly.
FIG. 2 is an exploded perspective view partially in section of the backshell adapter assembly illustrated in FIG. 1.
Figures 3, 4:
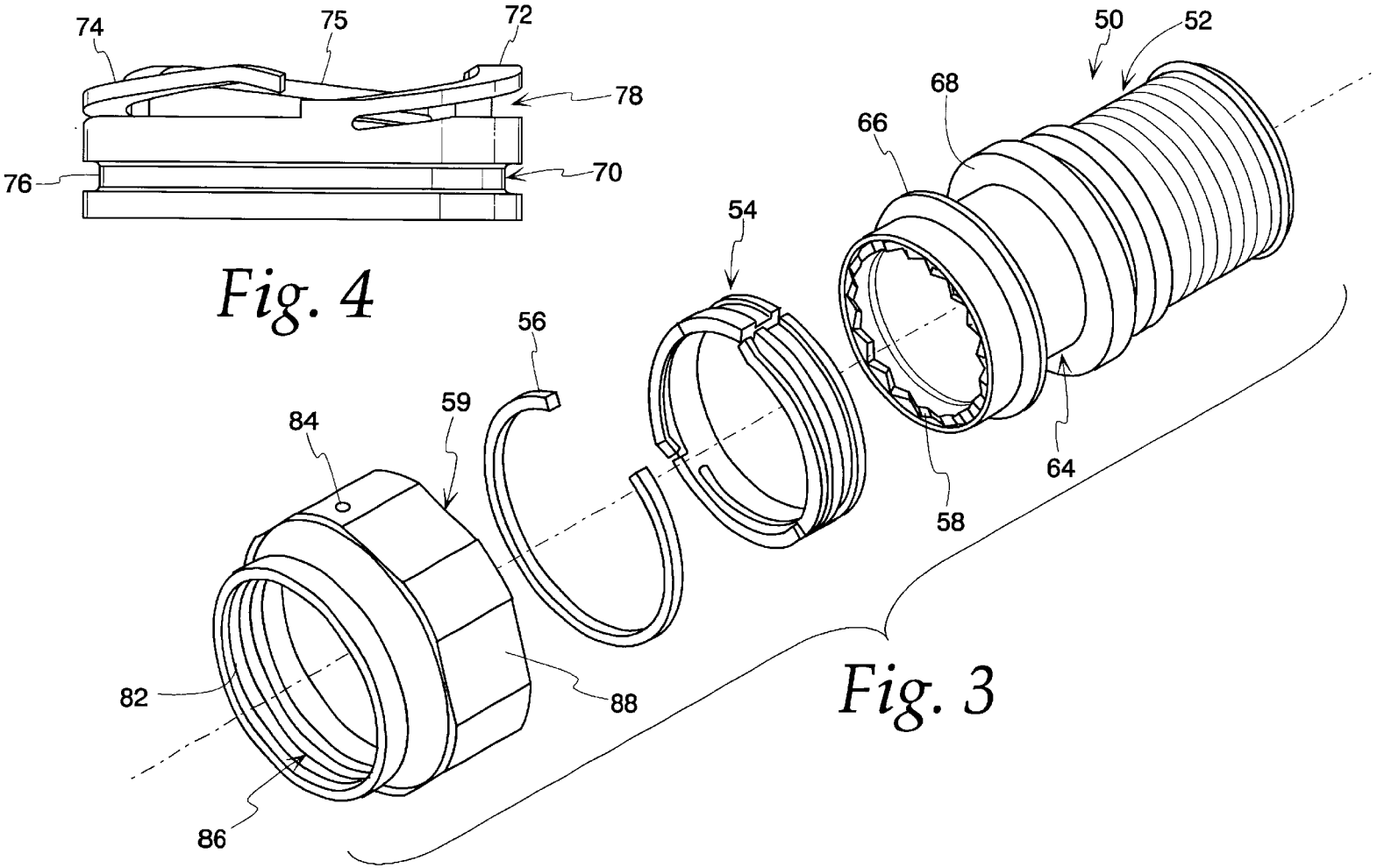
FIG. 3 is an exploded perspective view of the backshell adapter assembly in accordance with the present invention.
FIG. 4 is a front view of the one-piece shuttle mechanism which forms part of the present invention.

Turning to FIGS. 3 and 4, the backshell adapter assembly in accordance with the present invention is generally identified with the reference numeral 50. The backshell adapter assembly 50 includes an adapter body 52, a one piece shuttle mechanism 54, a retaining ring 56 and a coupling nut 58. The adapter body 52 is formed as a generally tubular member with an aperture 56 for receiving a plurality of electrical conductors (not shown). One end of the adapter body 52 is provided with a plurality of interlocking teeth, aligned in an axial direction, disposed around the periphery of the adapter body 52. The interlocking teeth 58 are adapted to mate with corresponding teeth 60 (FIG. 5) on an electrical connector 62. Proper engagement of the interlocking teeth 58 on the adapter body 50 with the interlocking teeth 60 on the connector shell 62 prevent rotation of the adapter body 50 relative to the connector shell 62.

The adapter body 52 also includes an annular retaining grove 64 formed by a pair of spaced apart annular shoulders 66 and 68. The annular retaining grove 64 is adapted to receive the one piece shuttle device 54.

As shown best in FIG. 3, the one piece shuttle 54 is cut across its axial length to enable the one piece shuttle mechanism 54 to be spread out and loaded into the retaining grove 64. In accordance with an important aspect of the invention, the one piece shuttle 54 is adapted to provide an axial force sufficient to overcome any rotational forces on the adapter body 52 to insure proper mating of the interlocking teeth 58 and 60 (FIG. 5) on the adapter body 52 (FIG. 3) and connector shell 52 (FIG. 5) respectively, when the backshell adapter assembly 20 is threaded onto the connector shell 62. In order to reduce the number of parts, the one piece shuttle 54 includes an integrally formed shuttle bushing portion 70 and one or more concentrically formed spring arms 72, 74 and 75. The thrust bushing portion 70 includes an annular retaining grove 76 for receiving the retaining ring 56. As will be discussed in more detail below, the retaining ring 56 is used to capture the coupling nut 58 relative to the adapter body 52.

Figure 5:
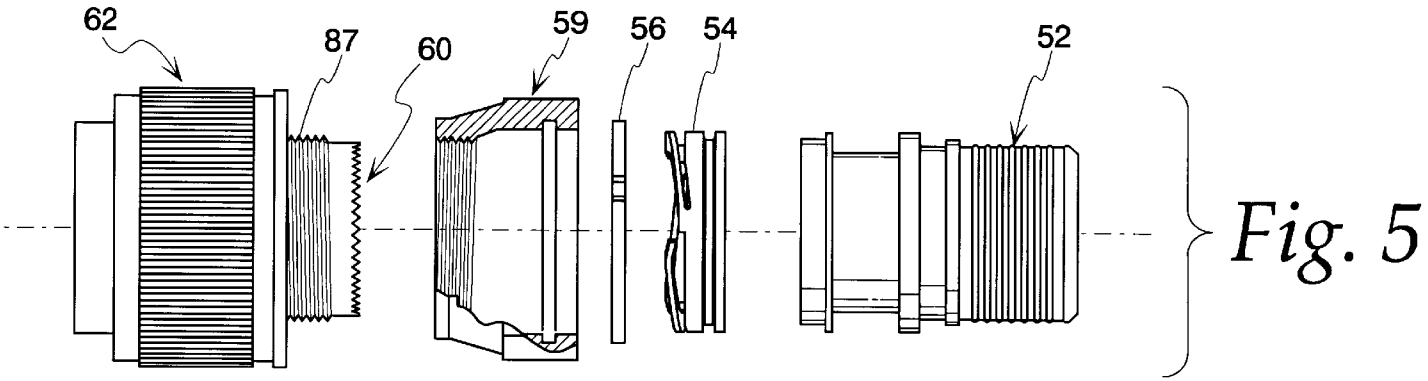
FIG. 5 is an exploded view of the backshell adapter assembly in accordance with the present invention and a conventional electrical connector with a backshell adapter assembly shown partially in section.

Although three spring arms are illustrated and described, more or less spring arms can be utilized. Each spring arm 72, 74 and 75 is concentrically formed relative to the thrust bushing portion 70 and consists of an arcuate section which corresponds to the curvature of the thrust bushing portion 70. Each arcuate section is connected on one end to the thrust bushing portion 70, as best shown in FIG. 4. The spring arms 72, 74 and 75 are formed to extend axially outwardly from the thrust bushing portion 70 defining a gap 78 therebetween. As such, as the backshell adapter assembly 20 is threaded onto the connector shell 62 (FIG. 5), the spring arms 72, 74 and 75 (FIGS. 3 and 4) are biased thereby closing the gap 78 to provide an axial biasing force in the direction of the electrical connector shell 62 (FIG. 5).

In accordance with another aspect of the invention, the ends 80 (FIGS. 3 and 4) of the one or more of the spring arms 72, 74 and 75 may be curved radially inwardly toward the thrust bushing portion 70. The bent end portions 80 prevent the spring arms 72, 74 and 75 from being flattened out when the coupling nut 52 is fully threaded onto the connector shell 62. As such, the one piece shuttle 54 is adapted to provide a continuous axial force, even when the shuttle 54 stops forward travel and even when the backshell adapter assembly 50 is fully tightened relative to the connector shell 62.

The one piece shuttle 54 may be formed from various composite materials, such as a thermoplastic material, such as Torlon, which is a generic material for Polyamide-imide. Since such thermoplastic materials may be chemically sensitive to certain chemicals, such thermoplastics are normally coated, for example, with nickel.

As discussed above, the retaining ring 56 is used to capture the coupling nut 59 relative to the adapter body 52. The retaining ring 56, may be formed in an arcuate shape conforming to the diameter of the retaining grove 76 and the one piece shuttle 70 defining spaced apart ends which enable easy loading of the retaining ring into the retaining groove 76 on the one-piece shuttle 70. In order to capture the coupling nut 59 relative to the adapter body, the retaining ring 56 may be formed from a composite material as discussed above. The retaining ring 56 is adapted to be received in an annual grove 82 formed in the coupling nut 59. The coupling nut 84 may be provided with one or more apertures 84 which can be used during disassembly of the coupling nut 59 from the adapter body 52.

The coupling nut 59 is provided with a plurality of threads 86 on one end, adapted to mate with corresponding threads 87 (FIG. 5) on the connector shell 62. The coupling nut 59 (FIG. 3) may also be provided with one or more flats 88 to facilitate tightening of the coupling nut 59 onto the connector shell 62 (FIG. 5).

The coupling nut 59 (FIGS. 3 and 4) and retaining ring 56 may be formed from various non-electrically conductive materials, known in the art as engineering polymers. Because of the chemical sensitivity of certain engineering polymers to certain fluids, these polymers are normally coated with, for example, nickel. The adapter body 52 may be formed from various materials, including aluminum or composite material as discussed above.

Figure 6:
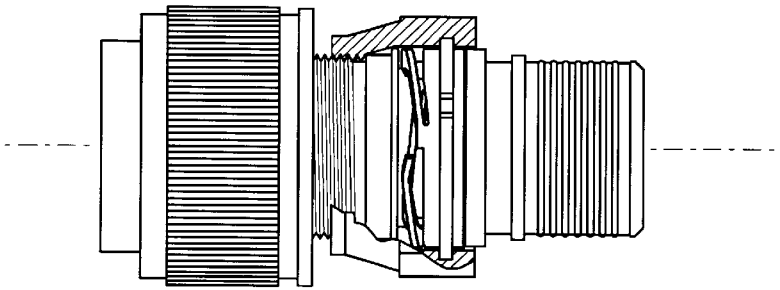
FIG. 6 is similar to FIG. 5 except shown with the coupling nut on the backshell adapter assembly partially threaded onto the electrical connector.
Figure 7:
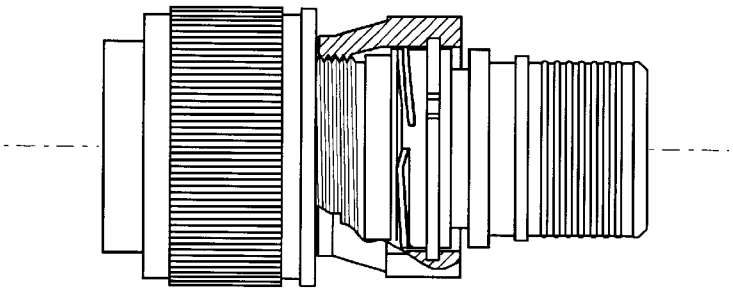
FIG. 7 is similar to FIG. 6 except illustrating the coupling nut fully threaded onto the electrical connector.

The operation of the one piece shuttle 54 is best understood with reference to FIGS. 5, 6 and 7. Initially, as the coupling nut 59 is threaded onto the connector shell 62, the spring arms 72, 74 and 75 are in at rest position, for example, as illustrated in FIG. 5. Once the coupling nut 59 is threaded onto the corresponding threads 87 on the connector shell 62, the spring arms 72, 74 and 75 begin to compress against the annular shoulder 66, as generally shown in FIG. 6, thereby providing an axial biasing force in the direction of the connector shell 62, for example, after one turn of the coupling nut 59. The axial biasing force overcomes any radial forces on the adapter body 52 and the teeth 58 on the adapter body 52 (FIG. 3) to properly mate with the corresponding teeth 60 on the connector shell 62. As the coupling nut 59 is tightened against the connector shell 62, the spring arms 72, 74 and 75 are compressed as generally shown in FIG. 7, thereby providing a continuous axial biasing force even after the coupling nut 59 is tightened to the connector shell 62. In accordance with an important aspect of the invention, the end portions 80 prevent the spring arms 72, 74 and 75 from being fully flattened out in a fully tightened position as best shown in FIG. 7.

Figure 8A:
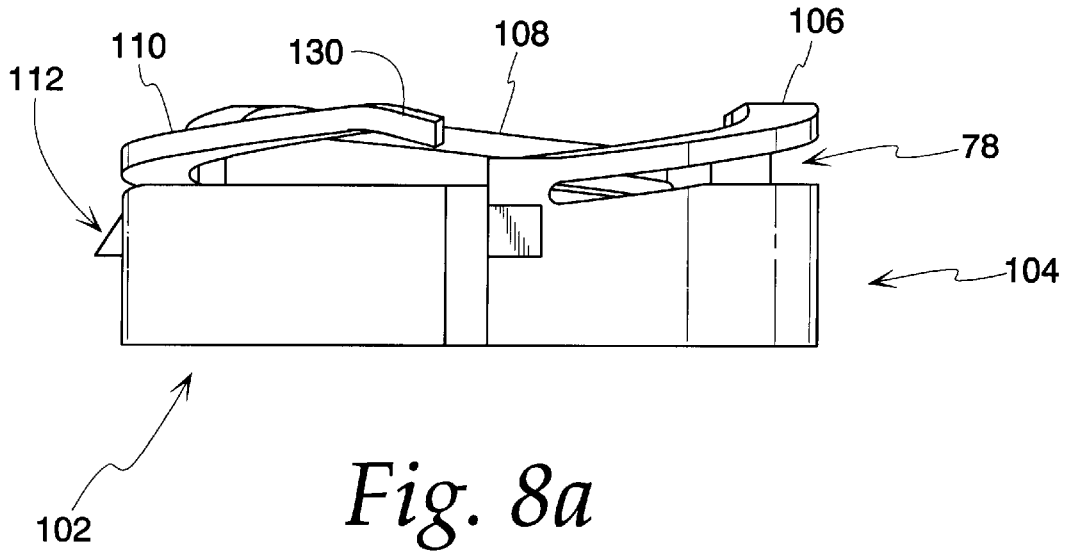
FIGS. 8A and 8B is a front view of an alternate embodiment of the one piece shuttle illustrated in FIG. 4.
Figure 8B:
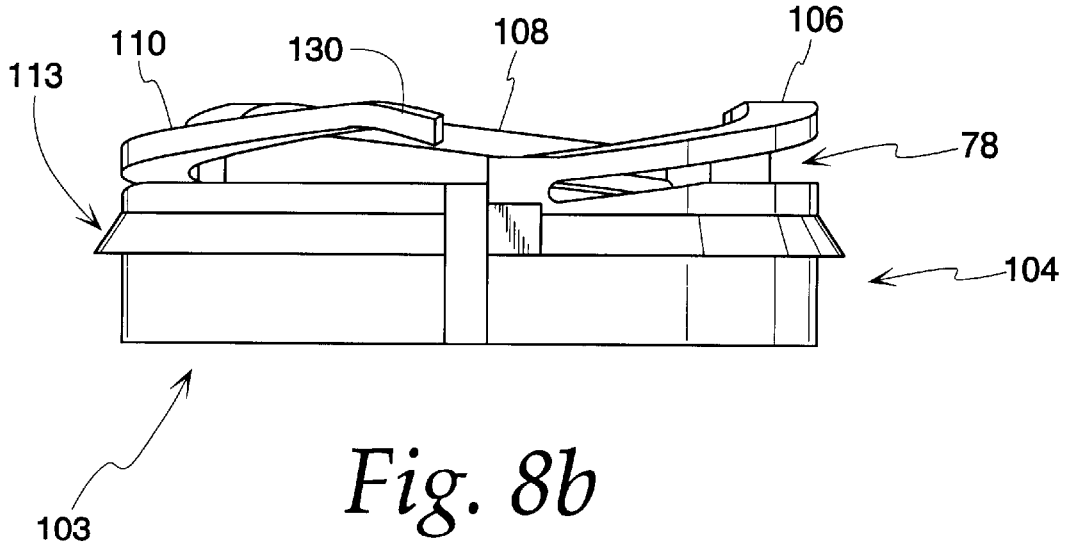
Figure 9:
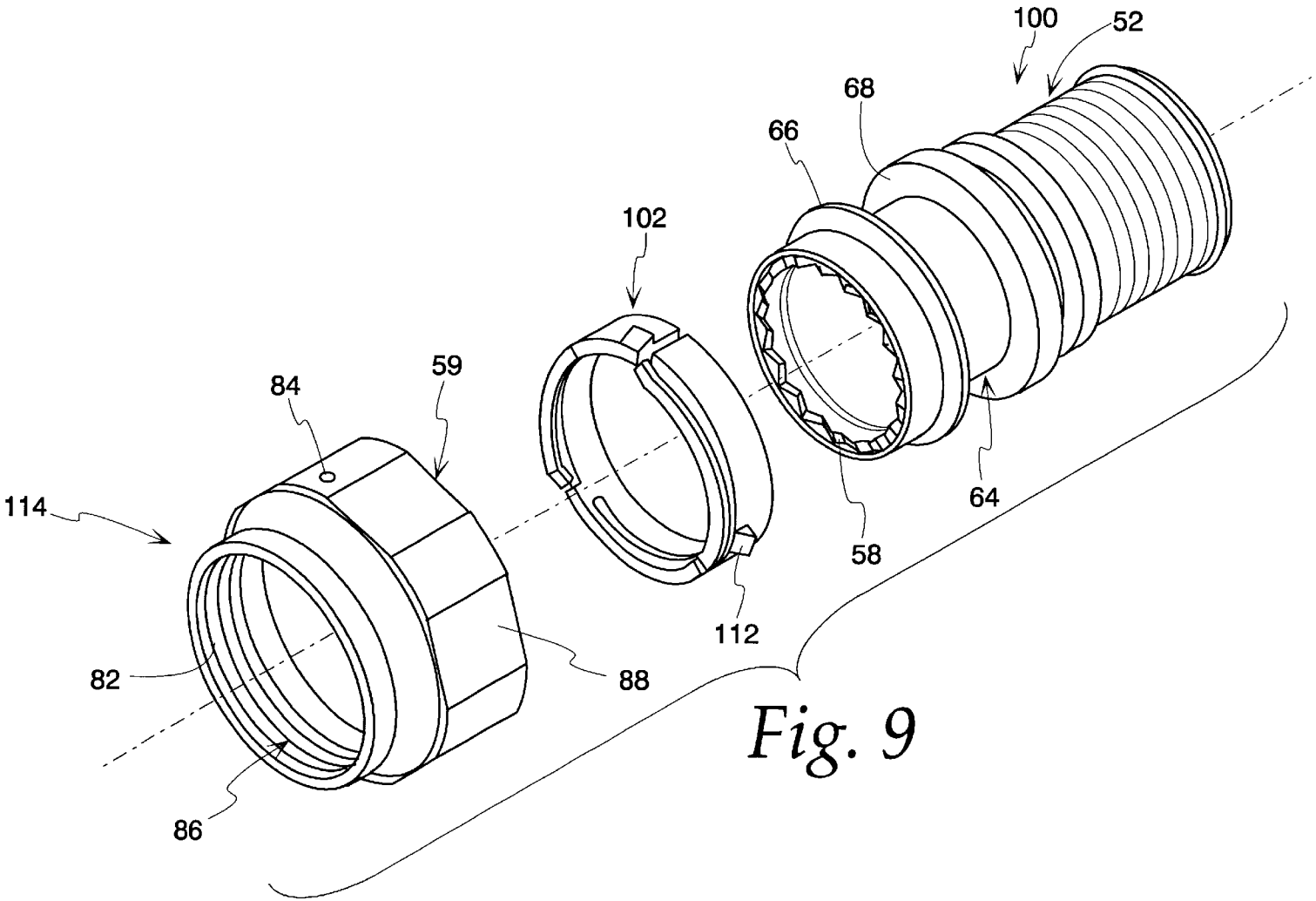
FIG. 9 is an exploded perspective view of an alternate embodiment of the backshell adapter assembly illustrated in FIG. 3.
Figures 10, 11, 12:
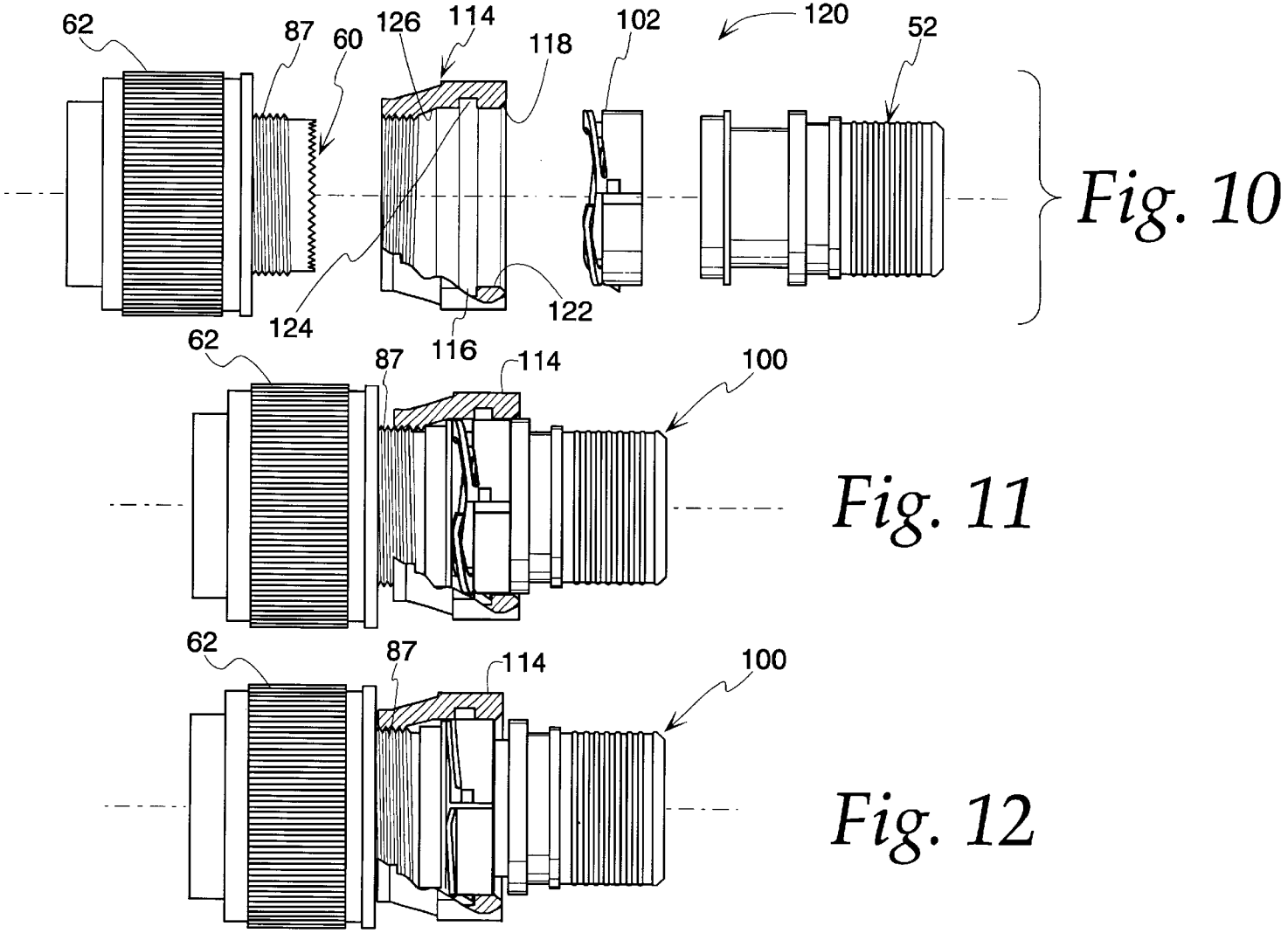
FIG. 10 is an exploded perspective view of the backshell adapter assembly shown in FIG. 9 and a conventional electrical connector with the backshell adapter assembly shown partially in section.
FIG. 11 is similar to FIG. 10 except shown with the coupling nut on the backshell adapter assembly partially threaded onto the electrical connector.
FIG. 12 is similar to FIG. 11 except illustrating the coupling nut fully threaded onto the electrical connector.

An alternate embodiment of the backshell adapter assembly is illustrated in FIGS. 8–13 and generally identified with the reference numeral 100. An important aspect of the backshell adapter assembly 100 is that it enables the retaining ring to be eliminated. As described below, like components relative to the embodiment illustrated in FIGS. 3–7 are identified with like reference numbers. Referring to FIGS. 8 and 9, a one-piece shuttle 102 is cut across an axial length to enable the one-piece shuttle mechanism 102 to be spread out and loaded into the retaining groove 64 on the backshell adapter assembly 100. Similar to the embodiment illustrated in FIG. 3, the one-piece shuttle 102 is adapted to provide an axial force efficient to overcome any rotational forces on the adapter body 52 to ensure proper mating of the interlocking teeth 58 and 60 on the adapter body 52 (FIG. 9) and the connector shell 52 (FIG. 10), respectively, when the backshell adapter assembly 100 is threaded onto the connector shell 62 as illustrated in FIGS. 11 and 12. In order to reduce the number of parts of the backshell adapter assembly 100, the one-piece shuttle 102 includes an integrally-formed thrust bushing portion 104 and one or more concentrically-formed spring arms 106, 108 and 110.

In accordance with an important aspect of one embodiment of the invention, the one-piece shuttle 102 is formed with one or more radially-extending protrusions 112 (FIG. 8A), formed in the shape of a wedge. These protrusions 112 provide a surface which compresses the one-piece shuttle 102 as it is being loaded into a coupling nut 114. More particularly, the coupling nut 114 is provided with an annular retaining groove 116 (FIG. 10). Once the one-piece shuttle 102 is loaded into the annular retaining grooves 64 on the adapter body 52, the one-piece shuttle 102 assumes its unloaded diameter. As the adapter body and one-piece shuttle subassembly is loaded into the coupling nut 114, the ramped surfaces of the protrusions 112 engage an angled annular shoulder 118 formed in the mouth of the coupling nut 114 causing the one-piece shuttle 102 to compress. As the shuttle 102 is moved axially in the direction of the arrow 120, the one-piece shuttle 102 will compress to a reduced-size diameter to enable the one-piece shuttle to move along the annular surface 122 within the coupling nut 114. Continued axial movement of the one-piece shuttle 102 in the direction of the arrow 120 causes the protrusions 112 to be disposed into the annular retaining groove 116 of the coupling nut 114. Since the diameter of the annular retaining groove 116 is relatively larger than the diameter of the annular surface 122, the radial spring compression force within the one-piece shuttle 102 causes the one-piece shuttle 102 to expand to its original diameter. Consequently, the protrusions 112 will engage the annular shoulder 24 formed by the annular retaining 116 to prevent axial movement of the adapter body 52 and shuttle subassembly in a direction opposite to the direction shown by the arrow 120. Another annular shoulder 126 formed in a forward portion of the coupling nut 114 prevents axial movement of the adapter body and one-piece subassembly 102 in the direction 120. As such, the protrusions 112 on the one-piece shuttle 102 eliminate the need for a retaining ring thus further minimizing the number of components required for the backshell adapter assembly 100. Alternatively, the protrusion can be formed as a continuous element 113 to form an alternative shuttle 103 as shown in FIG. 8B.

The operation of the backshell adapter assembly 100 is similar to the operation of the backshell 20 as illustrated in FIGS. 11 and 12. More particularly, as the coupling nut 114 is threaded onto the connector shell 62 as illustrated in FIGS. 11 and 12, the spring arms 106, 108 and 110 on the one-piece shuttle 102 are in an at "rest position" as illustrated in FIG. 11. Once the coupling nut 114 is threaded onto the corresponding threads 87 on the connector shell, the spring arms 106, 108 and 110 begin to compress against the annular shoulder 66 (FIG. 9) on the backshell adapter body 52 thereby providing an axial biasing force in the direction of the connector shell 62, for example, after one turn of the coupling nut 114. This axial biasing force overcomes any radial force on the adapter body 52 causing the teeth 58 on the adapter body 52 to properly mate with the corresponding teeth 60 on the connector shelf 62. As the coupling nut 114 is tightened against the connector shell 62, spring arms 106, 108 and 110 are compressed as generally shown in FIG. 12, thus providing a continuous axial biasing force even after the coupling nut 114 is tightened to the connector shell 62. Similar to the embodiment illustrated in the FIGS. 3–7, the spring arms 106, 108 and 110 may be formed with end portions 130 (FIG. 8) to prevent the spring arms 106, 108 and 110 from being fully flattened out in a fully tightened position as best shown in FIG. 12.

Figure 13:
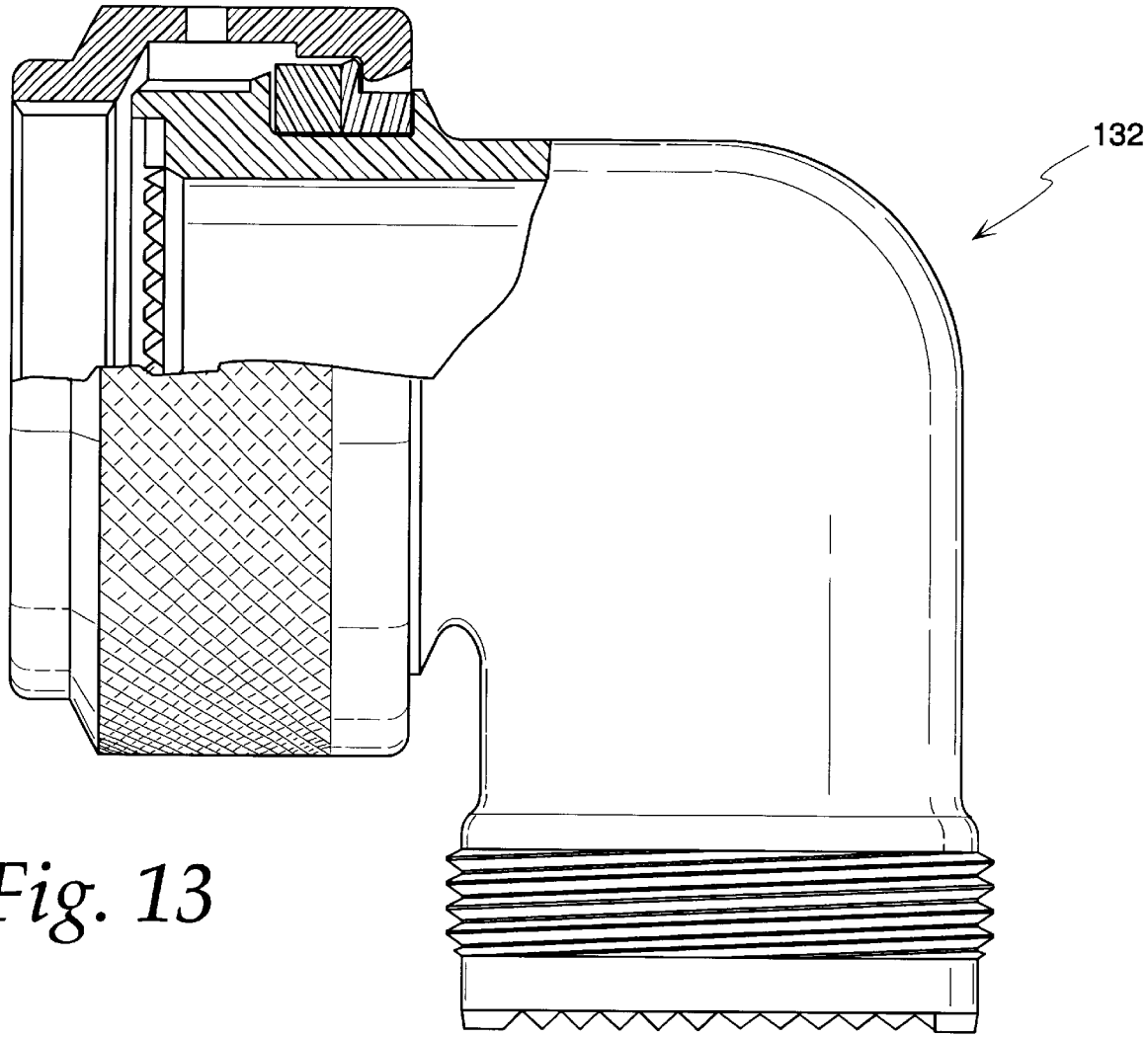
FIG. 13 is an exemplary embodiment of the backshell adapter assembly illustrated in FIG. 9, configured as a 90° elbow, shown partially in section.

Both the embodiment illustrated in FIGS. 3–7 as well as the embodiment illustrated in FIGS. 8–13 are amenable to being configured in many different ways. For example, the backshell adapter assembly 102 may be form an exemplary 90° elbow configuration as shown in FIG. 13. In this embodiment, the adapter body 52 is formed in a 90° elbow. All other components are the same and function in the same manner and described above. In addition to the 90° elbow configuration illustrated in FIG. 13 as well as the straight configuration illustrated in FIGS. 3–12, the principles of the present invention can be applied to basically any configuration backshell adapter body, for example, a 45° elbow (not shown).

Another alternate embodiment of the invention, eliminates the need for a retaining ring is shown in FIGS. 14A–15B. In this embodiment, the adapter body, identified with the reference numeral 152, is formed with two annular grooves, 154 and 156, having different radii. An angled transition surface 158 is formed between the grooves 154 and 156. These grooves 154 and 156 are formed in lieu of the groove 64 and opposing side walls 66 and 68 in the adapter body 52, illustrated in FIG. 9. The arrow, identified with the reference numeral 160, indicates the direction of the end of the adapter body 152 that receives a coupling nut 162 (FIG. 15A). All other features of the adapter body 152 are the same as the adapter body 52 and are not shown for clarity. In order to demonstrate the general principles of this embodiment of the invention, FIGS. 14B and 14C illustrate the a positions of the one piece shuttle 102, 103 in a first position as illustrated in FIG. 14B and a second position as illustrated in FIG. 14C. Referring first to FIG. 14B, initially, as discussed above, as the coupling nut 162 is initially tightened onto the adapter body 152, the ramped surfaces of the protrusions 112, 113 are forced rearward (i.e. in a direction as identified by the arrow 163). In particular, an annular shoulder 164 (FIG. 15B), formed on the interior of the coupling nut 162 engages the protrusion 112, 113 as the coupling nut 162 is loaded onto the adapter body 152 and moved in an axial direction, parallel to the arrow 162. As shown in FIG. 15A, the coupling nut 162 includes an angled surface 166, adjacent the shoulder 164. The angled surface 166 on the coupling nut 162 cooperates with the protrusion 112, 113 to slightly spread the mouth of the coupling nut 162 to allow the shoulder 164 on the coupling nut 162 to pass over the protrusion 112, 113 as shown in FIG. 15A. A rear groove surface 168 is used as a stop to secure the shuttle 102 in place as the shoulder 164 on the coupling nut 162 is passed over the protrusion 112, 113 to the position shown in FIGS. 14B and 15A, in which the shuttle 102 is forced into the recessed groove 156. As shown in FIGS. 14B and 15A in this position, the shoulder 166 formed on the coupling nut 162 engages a vertical flat surface 170 of the protrusion 112, 113 which captures the coupling nut 162 relative to the shuttle 102.

Figure 14C:
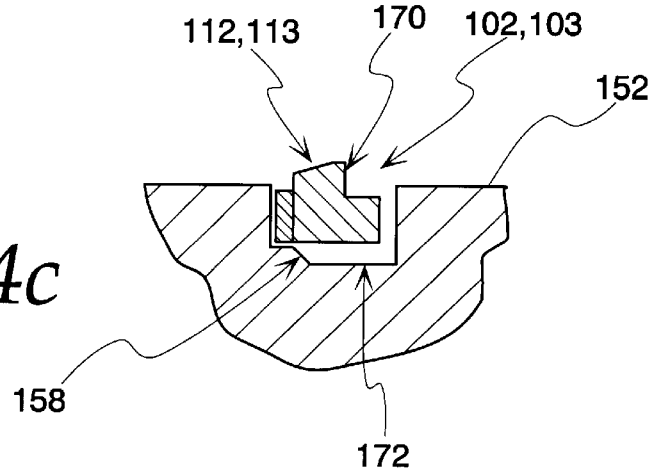
FIG. 14C is similar to FIG. 14B but illustrating the shuttle in a position of advanced tightening.
Figure 15B:
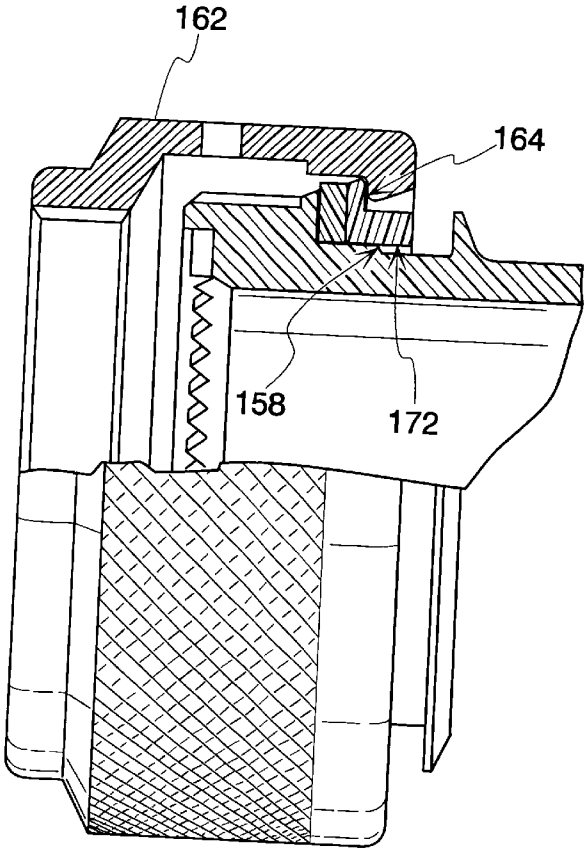
FIG. 15B is a partial sectional view of an alternate embodiment of the backshell adapter assembly in accordance with the present invention in which the adapter body is formed with a pair of annular grooves with a transition surface therebetween shown with the shuttle in a position of advanced lightening.
Figure 15A:
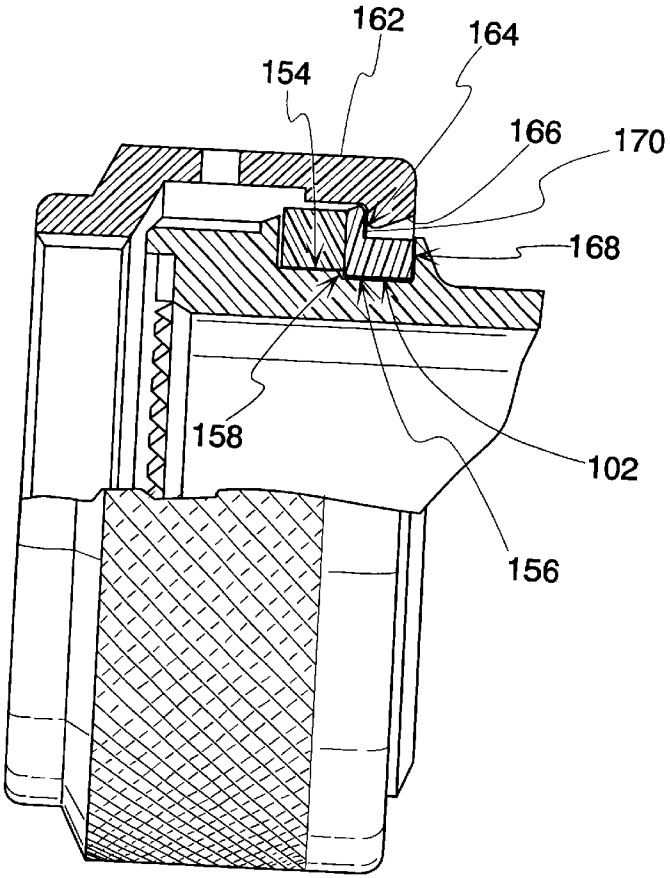
FIG. 15A is a partial sectional view of an alternate embodiment of the backshell adapter assembly in accordance with the present invention in which the adapter body is formed with a pair of annular grooves with a transition surface therebetween shown with the shuttle in a position of initial lightening.

As the coupling nut is threaded onto a connector 60, the coupling nut 162 was drawn forward. This action causes the annual shoulder 166 on the coupling nut 162 to direct force on the vertical flat surface 170 (FIG. 14C) of the protrusion 112, 113 in a direction parallel to the arrow 160. This force causes the shuttle to move up the transition surface 158 so that the inner diameter of the shuttle 102, 103 is resting in the recessed groove 154, which forms a raised landing as shown in FIGS. 14C and 15B.

Figure 14A:
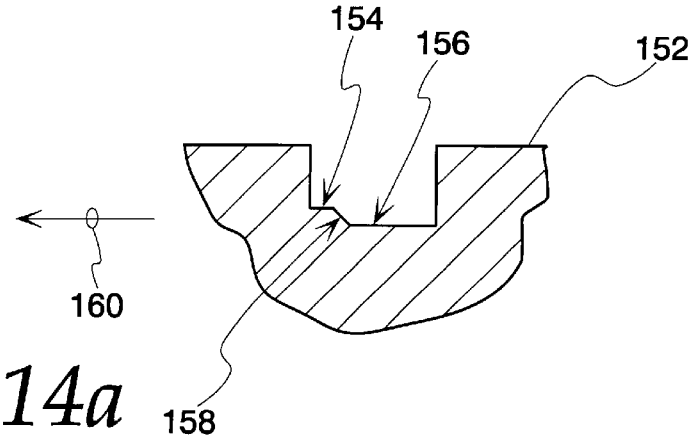
FIG. 14A is a partial sectional view of the adapter body formal with a pair of annular grooves with a transition surface therebetween in accordance with an alternate embodiment of the invention.
Figure 14B:
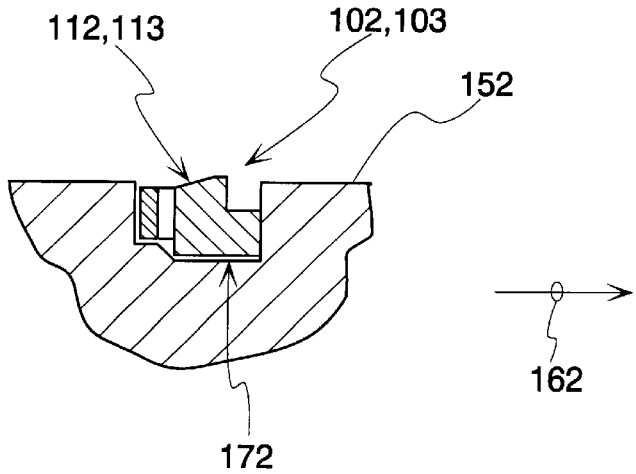
FIG. 14B is similar to FIG. 14A but illustrating the shuttle in a position of initial tightening.

As shown in FIG. 14B when the shuttle 102, 103 is within the recessed groove 156, the inner diameter of the shuttle rests on the recessed groove 156 and has a first diameter. As the shuttle 102, 103 is forced up the transition surface 158, in a matter as discussed above, the shuttle 102, 103 assumes a relatively larger diameter, as shown in FIG. 14C. The larger diameter further secures the shuttle 102, 103, and, in particular, the flat vertical surfaces 170 of the protrusion 112, 113 relative to the interior annular shoulder 164 on the coupling nut 162 to axially secure the coupling nut 161 as well as exert and axial force on the shuttle 102, 103 in a direction parallel to the arrow 160 to provide an axial biasing force to force proper mating of the anti-rotation teeth on the adapter body 152 relative to the corresponding teeth 60 on an electrical connector 62 when the coupling nut 162 is being secured thereto.

Obviously, many modifications and variations of the present invention are possible in light of the above teachings. Thus, it is to be understood that, within the scope of the appended claims, the invention may be practiced otherwise than as specifically described above.

What is claimed is:

1. A backshell adapter assembly comprising:

a generally tubular adapter body formed with a pair of spaced apart annular shoulders defining a first retaining groove, said adapter body also formed with a plurality of teeth, axially aligned and formed on one end of said adapter body;

a generally tubular one-piece shuttle, configured to be received in said first retaining groove, said one-piece shuttle formed with a thrust bushing portion and one or more spring arms, said thrust bushing configured with a second retaining groove, said one piece shuttle formed with an axial notch defining two ends which enables said one pierce shuttle to be expanded in diameter so that it can be disposed in said first retaining groove;

a retaining ring adapted to be received in said second retaining groove;

a coupling nut formed with an annular groove for receiving said retaining ring to prevent axial movement between said adapter body and said coupling nut, said coupling nut also formed with threads on one end for mating with corresponding threads on an electrical connector.

2. The backshell adapter assembly as recited in claim 1, wherein said spring arms are formed as arcuate portions connected on one end to said thrust bushing portion.

3. The backshell adapter assembly as recited in claim 2, wherein said spring arms extend axially away from said thrust bushing portion.

4. The backshell adapter assembly as recited in claim 3, wherein one or more ends of said one or more spring arms are bent axially inwardly toward said thrust bushing portion.

5. The backshell adapter assembly as recited in claim 1, wherein said shuttle is formed from a non-metallic material.

6. The backshell adapter as recited in claim 5, wherein said material is a thermoplastic material.

7. The backshell adapter assembly as recited in claim 1 wherein one or more ends of said one or more spring arms are axially inward towards the thrust bushing portion.

8. A backshell adapter assembly comprising:

a generally tubular adapter body formed with a pair of spaced apart annular shoulders defining a first retaining groove, said adapter body also formed with a plurality of teeth, axially aligned and formed on one end of said adapter body;

a generally tubular one-piece shuttle, configured to be received in said first retaining groove, said one-piece shuttle formed with a thrust bushing portion, one or more spring arms, and one or more radially extending protrusions, said one-piece shuttle having an at rest diameter and configured to enable said diameter to be reduced when compression forces are exerted on said protrusions;

a coupling nut formed with an annular groove for receiving said protrusion to prevent axial movement between said adapter body and said coupling nut, said coupling nut also formed with threads on one end for mating with corresponding threads on an electrical connector.

9. The backshell adapter assembly as recited in claim 8, wherein said spring arms are formed as arcuate portions connected on one end to said thrust bushing portion.

10. The backshell adapter assembly as recited in claim 9, wherein said spring arms extend axially away from said thrust bushing portion.

11. The backshell adapter assembly as recited in claim 10, wherein one or more ends of said one or more spring arms are bent axially inwardly toward said thrust bushing portion.

12. The backshell adapter assembly as recited in claim 8, wherein said shuttle is formed from a non-metallic material.

13. The backshell adapter as recited in claim 12, wherein said material is a thermoplastic material.

14. A backshell adapter assembly comprising:

a generally tubular adapter body formed with a pair of annular grooves having different radii and an angled surface therebetween defining a recessed groove and a raised platform;

a generally cylindrical one piece shuttle split in an axial direction formed with a thrust portion, one or more spring arms and one or more radially extending protrusions, said shuttle configured to be received on said adapter body having an at rest diameter in said recessed groove and an expanded diameter on said raised landing; and a coupling nut formed with an annular shoulder formed with threads on one end for mating with an electrical connector and formed with an interior annular shoulder on an opposing end.

15. The backshell adapter assembly as recited in claim 14, wherein said spring arms are formed as arcuate portions connected to one end to said thrust bushing portion.

16. The backshell adapter assembly as recited in claim 15, wherein said spring arms extend axially away from said thrust bushing portion.

17. The backshell adapter assembly as recited in claim 16, wherein one or more ends of said one or more spring arms are bent axially inwardly toward said thrust bushing portion.

18. The backshell adapter assembly as recited in claim 14, wherein said shuttle is formed from a non-metallic material.

19. The backshell adapter as recited in claim 18, wherein said material is a thermoplastic material.

* * * * *